US005268204A

United States Patent [19]

Hill et al.

[11] Patent Number: 5,268,204

[45] Date of Patent: Dec. 7, 1993

[54] METHOD FOR PRODUCING DECORATIVE PAPER USING A SLOT COATER, DECORATIVE PAPER, AND DECORATIVE LAMINATES PREPARED THEREFROM

[75] Inventors: Larry O. Hill, Frankfort, Ohio; Mahendra Mehta, Pittsfield, Mass.

[73] Assignee: The Mead Corporation, Dayton, Ohio

[21] Appl. No.: 843,530

[22] Filed: Feb. 28, 1992

[51] Int. Cl.[5] ..... B05D 3/02

[52] U.S. Cl. ..... 427/393; 427/385.5; 427/389.9; 427/394; 427/397

[58] Field of Search ..... 427/385.5, 389.9, 393, 427/394, 397

[56] References Cited

U.S. PATENT DOCUMENTS

| | | | |
|---|---|---|---|
| 3,102,064 | 8/1963 | Wurzburg et al. | 162/158 |
| 4,713,138 | 12/1987 | Ungar et al. | 156/307 |
| 4,888,220 | 12/1989 | Mehta | 162/134 |
| 5,032,225 | 7/1991 | Saji et al. | 427/395 |

*Primary Examiner*—Anthony McFarlane
*Assistant Examiner*—Nhat D. Phan
*Attorney, Agent, or Firm*—Thompson, Hine and Flory

[57] ABSTRACT

A method for uniformly coating the uppermost surface of a fibrous cellulosic decor sheet with an aqueous or melamine-based slurry containing a colorant using a slot coater; a decor sheet prepared by such method; and a laminate employing such decor sheet are described.

14 Claims, No Drawings

METHOD FOR PRODUCING DECORATIVE PAPER USING A SLOT COATER, DECORATIVE PAPER, AND DECORATIVE LAMINATES PREPARED THEREFROM

BACKGROUND OF THE INVENTION

The present invention relates to a method for producing colored paper for use in decorative laminates by applying to the surface of a bleached fibrous cellulosic sheet, a slurry containing a colorant, an opacifying agent and a binder using a slot coater.

The preparation of colored paper for use in laminates previously has involved adding the colorants or pigments to the pulp prior to forming the decorative paper. In the prior processes, adjustments in color of the paper to obtain a color match involve adding an amount of the desired materials to the batch of pulp, running a small amount of paper on the paper machine, and then stopping the machine while a laminate of the papers is prepared for comparison against a standard. If the color is not right, additional pigments are added to the pulp and the procedure is repeated. The starting, stopping and comparison procedures generally take between 15 and 60 minutes per trial. Therefore, in order to obtain a satisfactory color match, the paper machine may be non-operational for long periods of time. Such processes can be very unattractive economically, especially when small orders are involved. Thus, it would be desirable to find a method of achieving good color match which may be reproduced consistently without the down time which is common in the previously known methods.

SUMMARY OF THE INVENTION

It has now been found that decor sheets having a uniform color coating and exhibiting excellent color match can be produced by using a slot coater to apply a slurry, preferably an aqueous slurry, containing colorant, an opacifying agent and a binder directly on the surface of the finished paper.

It is an object of the present invention to provide a method for producing a decorative sheet which comprises uniformly applying to the surface of a dry decorative sheet, using a slot coater, a slurry containing one or more pigments or colorants, opacifying agent and a binder.

It is another object of the present invention to provide a colored decor sheet which comprises a sheet of fibrous cellulosic material having a colorant coated on the uppermost surface thereof, said colorant having been uniformly applied to said decor sheet using a slot coater.

It is yet another object of the present invention to provide a decorative laminate comprising a plurality of fibrous cellulosic core sheets impregnated and bonded together with a thermosetting resin, and a colored decor sheet having a colorant coated thereon, said colorant having been uniformly applied to the outer surface of said decor sheet using a slot coater. An abrasion-resistant overlay may be advantageously employed in the practice of this invention. These and other objects and the advantages of the present invention will become apparent from the following description.

DETAILED DESCRIPTION OF THE INVENTION

In accordance with the present invention, a slurry containing one or more colorant is applied as a uniform coating on the uppermost surface of a decor sheet using a slot coater. The coated sheet can be saturated with a melamine resin in a known manner similar to that previously used in preparing decorative sheets. Titanium dioxide may also be present in the slurry in major amounts as an opacifying agent to provide the desired opacifying or hiding effect.

The present invention employs a slot coater to produce a uniformly colored coating on the rough porous surface of papers for use as decor sheets in the preparation of decorative laminates. The uniformly colored coating minimizes mottle which is a major problem with other coating methods.

In addition to creating a very smooth and uniform coating, the slot coating method of the present invention provides an easier and faster method for consistently reproducing the color of the paper to obtain a superior color match. By using a small family of colors for base papers, coatings of similar shades can be applied to the raw stock to create a large number of colors. The coating head color system of the slot coater can be small so that any adjustments to color are very quick and very precise, and once a color match is achieved, it will not change due to any recycled material.

While this application makes reference to titanium dioxide as an opacifying agent, those skilled in the art will appreciate that equivalent opacifying pigments such as clay, amorphous silica, etc., may be used in place of, or in combination with, titanium dioxide. The amount of titanium dioxide and colorant can be adjusted to provide the desired color and opacifying or hiding effect. The combined amount of titanium dioxide and colorant in the coating will be about 50 to 150% based on the fibrous decorative sheet.

The slurry employed in the present invention is preferably an aqueous based slurry containing the desired colorants, opacifying agents and binder. Although the aqueous slurry may be applied to the decor sheet on the paper making machine, it is generally advantageous to apply the slurry directly onto a dry decor sheet off the paper machine. The coated decor sheet is dried to provide a uniformly coated decor sheet having a consistent color for use in decorative laminates.

The binder material may be any of the commonly used binders such as silica aerogel, fumed silica, microcrystalline cellulose, sodium alginate, melamine, etc., used in coating compositions where the coating material needs to be bonded to the substrate material. Melamine resins such as melamineformaldehyde are advantageously used as the binder material since the melamine-formaldehyde resin is commonly used to saturate the substrate or decor sheet.

The slurry may also be a melamine-based slurry, in which case the melamine may be the same resin as that used to impregnate the decor sheet during its manufacture on the paper machine. As one might expect, it is not necessary for the decor sheet to be fully saturated with melamine or similar impregnating resin where the slurry to be employed is a melamine-based slurry since the slurry will provide the additional resin to fully saturate the decor sheet.

The core sheets of the laminate may be of any desired type, and core sheets such as those derived from wood, particle board, plaster board, asbestos board and the like are contemplated as being within the scope of the invention, as well as the commonly used plies of bleached or unbleached kraft paper which are impregnated with resins such as phenolformaldehyde resins, etc. The number of core sheets making up a decorative laminate will depend upon the desired thickness of the laminate and the basis weight of the papers used. The laminate may range from 1/16 to ½ inch thick and preferably 12 to 1/5 inch thick. In most instances, the laminate will contain approximately 5 to 8 core sheets. In other cases, however, where a particularly thick laminate is desired, the laminate may contain up to 40 core sheets. On the other hand, if a heavier basis weight paper is used, the laminate may be formed from as few as two or three core sheets. The core sheets useful in the present invention preferably have a basis weight of about 30 to 200 pounds per 3000 square feet and, most preferably, about 70 to 150 pounds per 3000 square feet.

Selection of the resin for impregnation of the core or decor sheets for multiple layer printed or unprinted decorative laminates will largely be governed by the intended end use of the finished laminate. Aminoplasts such as melamineformaldehyde resins, acrylics such as polyacrylonitrile, polyester resins such as diallyl phthalate, phenolic resins, polyurethanes, and epoxy resins may be used. Such resins are widely used in the art.

The overlay sheet can be formed from fibers conventionally used for this purpose. One of the most common fibers is alpha cellulose or mixtures thereof with other cellulose fibers. Also useful is a highly bleached fibrous cellulosic pulp or alpha pulp beaten to a Canadian Standard Freeness of about 500 ML.

The cellulose fibers used in the present invention are preferably a bleached Kraft pulp, although any fiber used in conventional decor sheets may be employed. The pulp may consist of hardwoods or softwoods or a mixture of hardwoods and softwoods. Higher alpha cellulose such as cotton may be added to enhance characteristics such as post-formability.

Additives such as alum, alkali and the like may be used to control end use characteristics such as post-forming. Wet strength resins may also be added for wet strength characteristics. A retention aid may be used if desired.

Furthermore, properties such as flame retardant characteristics and abrasion resistance can be introduced during or after the papermaking process using technology which is already available.

The basis weight of the decorative sheets may range from approximately 30 to 100 pounds per 3000 square feet and preferably ranges from approximately 45 to 75 pounds per 3000 square feet.

The decor sheet is impregnated with a laminating resin in an otherwise conventional manner. The sheets are preferably impregnated with commercially available melamine-formaldehyde or polyester resins and subsequently dried to a non-tacky but fusible state.

Various patterns may be printed or created on these decorative sheets. Most typically, a marble grain or wood grain pattern or portions of a marble pattern or wood grain pattern such as selected colored streaks will be printed on the sheets. A typical print-containing laminate includes a number of core sheets and at least one decor sheet to which a predetermined color has been slot coated on the surface thereof.

In accordance with the preferred embodiments of the invention, the top sheet of the laminate is a printed or unprinted decor sheet in which the outermost surface of the decor sheet is coated with a colorant-containing slurry and, optionally, titanium dioxide, off the paper making machine using a slot coater.

Laminates in accordance with the present invention may be provided with glossy, matt or satin finishes in a known manner. It may be advantageous to apply a transparent protective coating over the decorative laminate to improve wear resistance of the decorative sheet.

Having described the invention in detail and by reference to preferred embodiments thereof, it will be apparent that modifications and variations are possible without departing from the scope of the invention defined in the appended claims.

What is claimed is:

1. A method for producing a colored decor sheet for use in decorative laminates which comprises applying colorant to the top surface of a bleached fibrous cellulosic sheet, said colorant being uniformly applied to said cellulosic sheet while on or off a paper making machine from a slurry containing said colorant using a slot coater; and drying said colored decor sheet.

2. The method of claim 1 wherein said slurry is an aqueous slurry.

3. The method of claim 1 wherein said slurry further contains an opacifying agent.

4. The method of claim 3 wherein said opacifying agent is titanium dioxide.

5. The method of claim 1 wherein said slurry further contains a melamine resin.

6. The method of claim 1 wherein said slurry is uniformly applied to said cellulosic sheet at a coat weight of about 10 to 40 pounds per 3000 square feet.

7. The method of claim 1 wherein said slurry is uniformly applied to said cellulosic sheet using said slot coater off the paper making machine.

8. The method of claim 1 wherein said fibrous cellulosic sheet includes hardwood and softwood fibers.

9. A colored decor sheet for use in decorative laminates, said decor sheet comprising a fibrous cellulosic sheet having a colorant coated on the top surface thereof, said colorant being uniformly applied to said decor sheet while on or off a paper making machine from a slurry containing said colorant using a slot coater.

10. The decor sheet of claim 9 wherein said slurry further contains an opacifying agent.

11. The decor sheet of claim 10 wherein said opacifying agent is titanium dioxide.

12. The decor sheet of claim 9 wherein said slurry further contains a resin.

13. The decor sheet of claim 9 wherein said colorant is applied to said decor sheet from a slurry containing said colorant using said slot coater off the paper making machine.

14. The decor sheet of claim 9 wherein said fibrous cellulosic decorative sheet contains hardwood and softwood fibers.

* * * * *